US010344962B2

(12) United States Patent
Hershman

(10) Patent No.: US 10,344,962 B2
(45) Date of Patent: Jul. 9, 2019

(54) REMOVABLE TRANSPARENT OR TRANSLUCENT DEBRIS SHIELD FOR A LIGHT FIXTURE DEVICE

(71) Applicant: LF Illumination, North Salem, NY (US)

(72) Inventor: Scott J. Hershman, North Salem, NY (US)

(73) Assignee: LF Illumination LLC, Chatsworth, CA (US)

( * ) Notice: Subject to any disclaimer, the term of this patent is extended or adjusted under 35 U.S.C. 154(b) by 0 days.

(21) Appl. No.: 15/600,360

(22) Filed: May 19, 2017

(65) Prior Publication Data

US 2018/0335202 A1 Nov. 22, 2018

(51) Int. Cl.

| | |
|---|---|
| ***F21V 31/00*** | (2006.01) |
| ***F21V 1/20*** | (2006.01) |
| ***F21V 1/22*** | (2006.01) |
| ***F21V 15/00*** | (2015.01) |
| ***F21V 17/16*** | (2006.01) |
| *F21W 131/40* | (2006.01) |
| *F21S 8/02* | (2006.01) |

(52) U.S. Cl.

CPC ..... *F21V 31/005* (2013.01); *F21V 1/20* (2013.01); *F21V 1/22* (2013.01); *F21V 15/00* (2013.01); *F21V 17/164* (2013.01); *F21S 8/026* (2013.01); *F21W 2131/40* (2013.01)

(58) Field of Classification Search

CPC ..... F21V 31/005; F21V 17/164; F21V 17/16; F21V 1/20; F21V 1/22; F21W 2131/40

USPC ..... 362/375, 311.01, 311.14, 396

See application file for complete search history.

(56) References Cited

U.S. PATENT DOCUMENTS

| | | | | |
|---|---|---|---|---|
| 6,554,453 | B2 * | 4/2003 | Rao | F21V 7/09 313/318.01 |
| 2002/0186557 | A1 * | 12/2002 | Lary | A42B 1/244 362/106 |
| 2010/0265721 | A1 * | 10/2010 | Zhou | F21K 9/00 362/311.01 |
| 2010/0328960 | A1 * | 12/2010 | Wang | F21V 29/004 362/373 |
| 2011/0044055 | A1 * | 2/2011 | Singer | F21V 3/00 362/311.01 |

* cited by examiner

*Primary Examiner* — Laura K Tso

(74) *Attorney, Agent, or Firm* — Kaplan Breyer Schwarz, LLP

(57) ABSTRACT

A debris shield for preventing debris from entering a light fixture device during a construction process while allowing the light fixture device to be used to illuminate an area where the construction process is taking place includes a transparent or translucent body and at least one projection arranged on or associated with the body for removably retaining the debris shield to the light fixture device. The debris shield can be removed from the trim ring after the construction process is completed by puncturing a closure covering an opening in the body of the debris shield and grasping the opening to pull the debris shield from the trim ring. Alternatively, the debris shield can be removed from the trim ring after the construction process is completed by grasping a pull tab on the body of the debris shield and using the pull tab to pull the debris shield from the trim ring.

20 Claims, 14 Drawing Sheets

REMOVABLE TRANSPARENT OR TRANSLUCENT DEBRIS SHIELD FOR A LIGHT FIXTURE DEVICE

FIELD

The present disclosure relates to lighting, and more particularly to a removable transparent or translucent debris shield for a light fixture device, which allows the light fixture device to be used as a worklight during construction while preventing debris from contaminating the lighting components of the light fixture device.

BACKGROUND

Building construction produces a considerable amount of airborne construction debris, such as dirt, sawdust, drywall dust, and paint overspray, which eventually coats various structures of the building area. Consequently, when light assemblies are installed in ceiling and walls during the construction process, a removable cardboard cover is provided in the light source aperture of each of the light fixture device until construction is completed, to prevent the airborne construction debris from entering the light fixture device and contaminating lighting components contained therein.

Although the removable cardboard cover is inexpensive and adequately prevents construction debris from entering the light fixture device, it does not allow the light fixture device to be used to illuminate the building area during the construction process. Therefore, temporary lighting must be installed to illuminate the building area.

Accordingly, a light fixture device debris shield is needed, which allows a wall or light fixture device to be used until construction is completed.

SUMMARY

Disclosed herein is debris shield for a light fixture device. The debris shield comprises: a transparent or translucent body; and at least one projection arranged on or associated with the body for removably retaining the debris shield to the light fixture device; whereby the debris shield prevents entry of construction debris into the light fixture device while allowing the light fixture device to be used to illuminate the building area during the construction process.

In some embodiments, the body is disc-, square-, or rectangular-shaped.

In some embodiments, the body is flat, substantially flat, concave, convex, domed, or frustoconical.

In some embodiments, the at least one retaining projection includes four retaining projections.

In some embodiments, the retaining projections are equispaced arranged on the body.

In some embodiments, the at least one retaining projection is elastically deformable.

In some embodiments, the at least one retaining projection is substantially rigid.

In some embodiments, the body further includes an opening or a pull tab for removing the debris shield.

In some embodiments, the body further includes an opening for removing the debris shield and a puncturable closure covering the opening.

In some embodiments, the puncturable closure includes instructions relating to the use of the debris shield.

In some embodiments, the body includes an exterior facing surface, an interior facing surface, and an outer edge surface separating the exterior and interior facing surfaces, and wherein the at least one projection is arranged on one of the exterior facing surface, the interior facing surface and the outer edge surface.

In some embodiments, the debris shield further comprises a skirt depending from a surface of the body, the at least one projection extending from the skirt.

In some embodiments, the at least one projection includes a retaining member and a lead-in member.

Further disclosed herein is a light fixture device comprising: an enclosure including a light source aperture surrounded by a trim ring, the light source aperture communicating with an interior of the enclosure; a light generating element disposed within the interior of the enclosure and aligned with the light source aperture; and the above-described debris shield removably attached to the trim ring.

In some embodiments, wherein the at least one retaining projection is elastically deformable, an inner surface of the trim ring includes at least one groove for receiving the at least one retaining projection.

In some embodiments, where the at least one retaining projection is substantially rigid, an inner surface of the trim ring includes at least one L-shaped groove for receiving the at least one retaining projection.

Further disclosed herein is a method for preventing debris from entering a light fixture device during a construction process while allowing the light fixture device to be used to illuminate an area where the construction process is taking place, the light fixture device having a light source aperture communicating with an interior of the light fixture device, a light generating element disposed within the interior of the light fixture device and aligned with the light source aperture, and a trim ring surrounding the light source aperture. The method comprises: providing a debris shield comprising a transparent or translucent body and at least one projection arranged on or associated with the body; removably attaching the debris shield to the trim ring of the light fixture device, the at least one projection removably retaining the debris shield to the trim ring, activating the light generating element to illuminate the area; and removing the debris shield from the trim ring after the construction process is completed.

In some embodiments, the removing of the debris shield from the trim ring after the construction process is completed includes puncturing a closure covering an opening in the body of the debris shield and grasping the opening to pull the debris shield from the trim ring.

In some embodiments, the removing of the debris shield from the trim ring after the construction process is completed includes grasping a pull tab on the body of the debris shield and using the pull tab to pull the debris shield from the trim ring.

BRIEF DESCRIPTION OF THE DRAWINGS

FIG. 1A illustrates the debris shield detached from the light fixture device and FIG. 1B illustrates the debris shield attached to the light fixture device.

FIG. 4A illustrates the debris shield detached from the light fixture device and FIG. 4B illustrates the debris shield attached to the light fixture device.

DETAILED DESCRIPTION

Figure 1A:
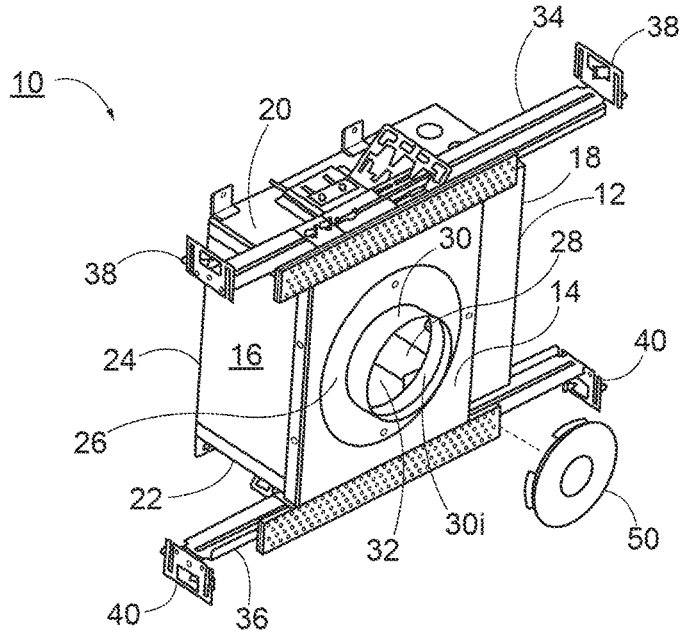
FIGS. 1A and 1B are perspective views illustrating an embodiment of a light fixture device with a removably attached transparent or translucent debris shield according to an embodiment of the present disclosure.

FIG. 1A illustrates a light fixture device 10 according to an embodiment of the present disclosure. The light fixture device 10 includes an enclosure 12 having a front wall 14, side walls 16, 18, 20, 22, and a rear wall 24. The enclosure 12 houses lighting components (not shown) of the light fixture device 10. The front wall 14 of the enclosure 12 includes an aperture plate 26. The aperture plate 26 has a light source aperture 28 surrounded by a circular trim ring 30. The light source aperture 28 of the aperture plate 26 communicates with the interior 32 of the enclosure 12. The interior of the enclosure 12 houses a light generating element (not visible), such as an incandescent bulb or LED, which is aligned with the light source aperture 28 of the aperture plate 16. Support braces 34 and 36 are provided on opposing side walls 20 and 22, respectively, of the enclosure 12. A mounting foot 38 is formed at each end of support brace 34 and a mounting foot 40 is formed at each end of support brace 36. The enclosure 12, aperture plate 26, support braces 34, 36 and mounting feet 38, 40 can be formed entirely or primarily of metal, such as sheet metal. Although the enclosure is depicted in the form of a box-like structure in the embodiment illustrated in FIG. 1A, the enclosure may have other forms.

The light fixture device 10 can be suspended between and attached to a pair of parallel extending ceiling joists or wall studs of a dwelling or room, via the support braces 34, 36 and the mounting feet 38, 40, respectively. Conventionally, the light fixture device 10 will be installed during construction or re-construction of the dwelling or room. The enclosure 12, support braces 34, 36 and mounting feet 38, 40 of the light fixture device 10 may be substantially or entirely concealed behind drywall attached to the joists of the ceiling or the studs of the wall, or substantially or entirely concealed behind a ceiling tile suspended from the joists of the ceiling. Consequently, an opening is formed in the drywall or ceiling tile, which aligns with the light source aperture 28 of the aperture plate 26 to permit light generated by the light generating element to pass into the room. A trim element (not shown) may be inserted through the opening in the drywall or ceiling, which extends through and removably attaches to the trim ring 30.

Figure 1B:
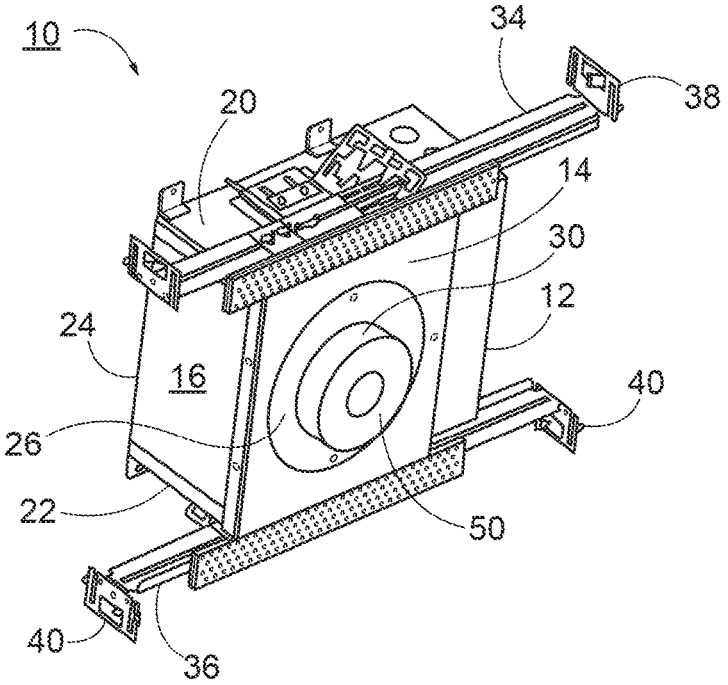

As illustrated in FIGS. 1A and 1B, the light fixture device 10 includes an embodiment of a transparent or translucent debris shield 50 according to the present disclosure, which is configured to be removably attached to the trim ring 30. The debris shield 50 prevents construction debris, such as dirt, sawdust, drywall dust, and/or paint overspray, from passing through the light source aperture 28 and into the interior 32 of the light fixture device enclosure 12 where it can contaminate the lighting components contained therein, while also allowing the light fixture device 10 to be used to illuminate the building area during the construction process. Therefore, the need to install temporary lighting to illuminate the building area during the construction process is substantially reduced or eliminated.

As collectively illustrated in FIGS. 2A-2F, the debris shield 50 used with the circular trim ring 30 illustrated in FIGS. 1A and 1B, comprises a flat or substantially flat disc-shaped body 52 having an exterior facing surface 54, an interior facing surface 56, and an outer edge surface 58 separating the exterior facing surface 54 and the interior facing surface 56. An annular skirt 57 depends from the interior facing surface 56 of the body 52. The annular skirt 57 has an outer diameter Ds that is slightly less than the inner diameter of the trim ring 30, which allows it to enter the trim ring 30. The disc-shaped body 52 has an outer diameter DB that is slightly greater than the outer diameter Ds of the annular skirt 57 so that a portion of the body 52 overhangs the annular skirt 57. The overhanging portion of the body 52 forms a stop surface 53 to prevent the body 52 from entering the trim ring 30. The stop surface 53 also operates to seal the opening of the trim ring 30 in a manner that prevents construction debris from entering the enclosure 12 of the light fixture device 10 through the trim ring 30 and the light source aperture 28. One or more retaining projections 60 extend from a free edge surface 59 of the annular skirt 57. The retaining projections 60 can be equi-spaced arranged on the free edge 59 of the annular skirt 57.

Figure 2A:
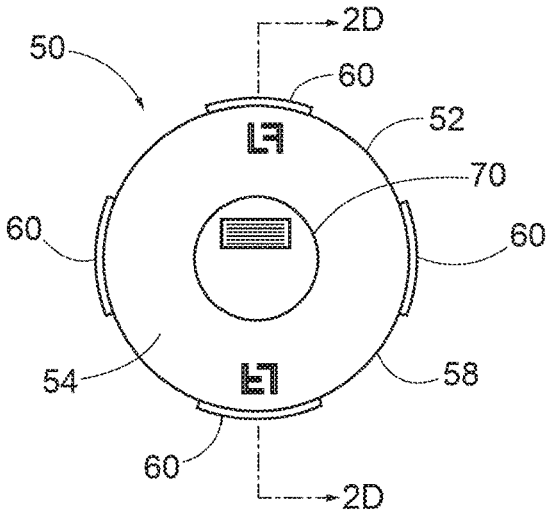
FIG. 2A is a top view of the debris shield illustrated in FIGS. 1A and 1B.
Figure 2B:
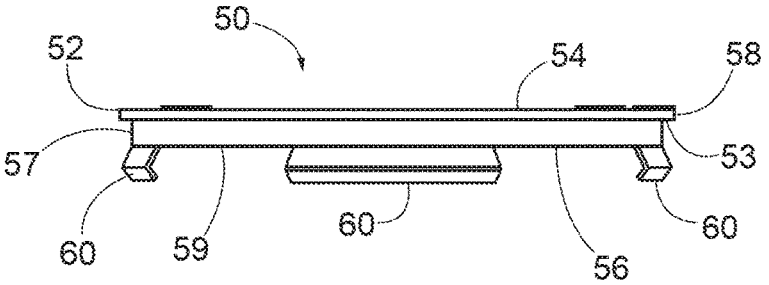
FIG. 2B is a side elevational view of the debris shield illustrated in FIGS. 1A and 1B.
Figure 2C:
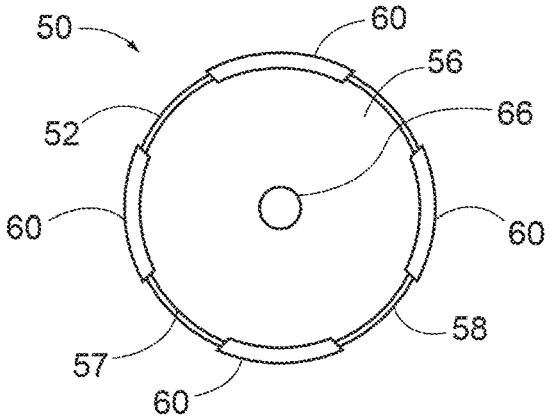
FIG. 2C is a bottom view of the debris shield illustrated in FIGS. 1A and 1B.
Figure 2D:
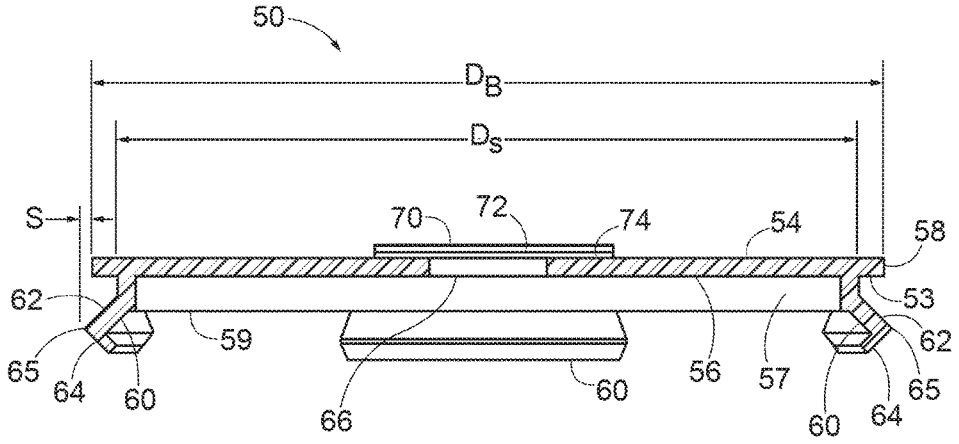
FIG. 2D is a cross-sectional view through line 2D-2D of the debris shield illustrated in FIG. 2A.

As best illustrated in FIGS. 2B and 2D, each retaining projection 60 defines an arcuate L-shaped structure formed by an arcuate retaining member 62 and an arcuate lead-in member 64. The arcuate retaining member 62 extends down and outward from the free edge surface 59 of the skirt 57 and the arcuate lead-in member 64 extends down and inward from the end of the arcuate retaining member 62. The junction where the arcuate retaining member 62 and the arcuate lead-in member 64 merge defines a trim ring engaging surface 65. The trim ring engaging surface 65 extends past the outer edge surface 58 of the body 52 by a distance S (FIG. 2D). In one illustrative embodiment distance S can be 0.017 inches. The retaining projections, in other embodiments, can have any suitable shape and/structure. For example, the retaining projections can include just the arcuate retaining member extending down and outward from the free edge of the skirt. The retaining projections 60 are configured to elastically deform as they engage the inner surface 30*i* of the trim ring 30 (FIG. 1A) when the transparent debris shield 50 is inserted into the opening of the trim ring 30, thereby removably attaching the debris shield 50 to the trim ring 30. In some embodiments, the inner surface 30*i* of the trim ring 30 may include a single continuous groove or individual grooves (not illustrated), for receiving the retaining projections 60. In such embodiments, the retaining projections 60 and the groove(s) form a detent, which permits removable attachment of the debris shield 50 to the trim ring 30.

Figure 2E:
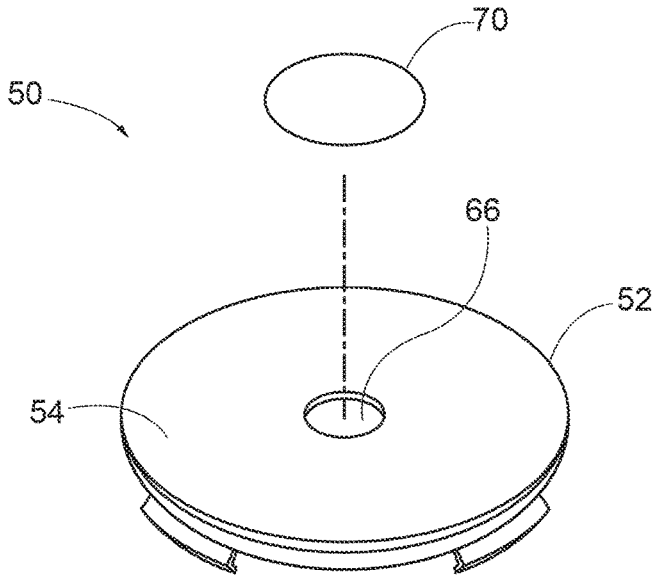
FIG. 2E is an exploded perspective view of the debris shield illustrated in FIGS. 1A and 1B.

As illustrated in FIGS. 2C, 2D, and 2E, the body 52 includes an opening 66 extending therethrough for inserting a finger or tool to remove the debris shield 50 from the trim ring 30 when the construction process has been completed. The opening 66 can be centrally located in the body 52, as illustrated in FIGS. 2C, 2D and 2E, or located elsewhere in the body 52.

Figure 3:
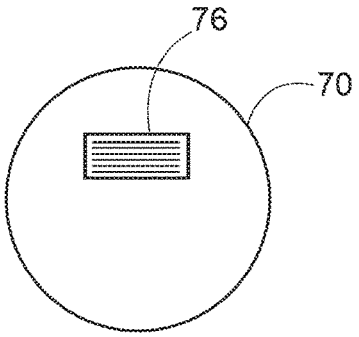
FIG. 3 is a top view of a closure of the debris shield.

Referring to FIGS. 2A, 2D and 2E, a puncturable closure 70 is adhesively attached to the exterior facing surface 54 of the body 52 and entirely covers the opening 66. As illustrated in FIG. 2D, the closure 70 can comprise a substrate 72 of paper or another material, which can be easily punctured by the user's finger or a tool, such as a screw-driver. The rear side of the closure 70 includes an adhesive 74 for attaching the closure 70 to the exterior facing surface 54 of the body 52. As best illustrated in FIG. 3, the front side of the closure 70 can include a message 76 that instructs the user to allow the debris shield 50 to remain in place until trim of the light fixture device 10 is installed.

Figure 2F:
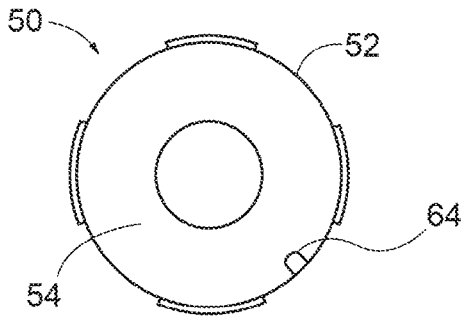
FIG. 2F is a top view of another embodiment of the debris shield that can be used with the light fixture device illustrated in FIGS. 1A and 1B.

Referring to FIG. 2F, in some embodiments, a pull tab 68 can be provided on the exterior facing surface 54 of the body 52 in place of or in addition to the opening 66, to facilitate installation and removal of the debris shield 50.

During installation of the transparent debris shield 50, the lead-in members 64 of the retaining projections 60 operate to align and center the debris shield 50 with the opening of the trim ring 30. As the debris shield 50 is pressed toward the trim ring 30, the retaining members 62 of the projections 60 elastically deform radially inward as the trim ring engaging surfaces 65 of the projections 60 slide along the inner surface 30*i* of the trim ring 30. The retaining members 62 snap back (radially outward) into their un-deformed state or substantially un-deformed state when the trim ring engaging surfaces 65 enter the groove or grooves (if provided) formed in or on the inner surface 30*i* of the trim ring 30. If no groove or grooves are provided in or on the inner surface 30*i* of the trim ring 30, the forces applied against the inner surface 30*i* of the trim ring 30 by the trim ring engaging surfaces 65, via the elastically deformed retaining members 62, are sufficient to hold the debris shield 50 in the trim ring 30.

The debris shield 50 can be removed by puncturing the closure 70 covering the opening 66 with a finger or tool. The finger or tool can then be inserted into the opening 66 to pull the debris shield 50 out of the trim ring 30. If equipped with the pull tab 68, the pull tab 68 can be grasped with fingers or a tool to pull the debris shield 50 out of the trim ring 30.

In other embodiments, the retaining projections 60 of the debris shield can be configured to be substantially rigid. In such embodiments, L-shaped receiving grooves (not illustrated) can be formed in or on the inner surface 30*i* of the trim ring 30 for respectively receiving the retaining projections, thus permitting the debris shield 50 to be removably attached to the trim ring 30 in a bayonet manner.

Figure 4A:
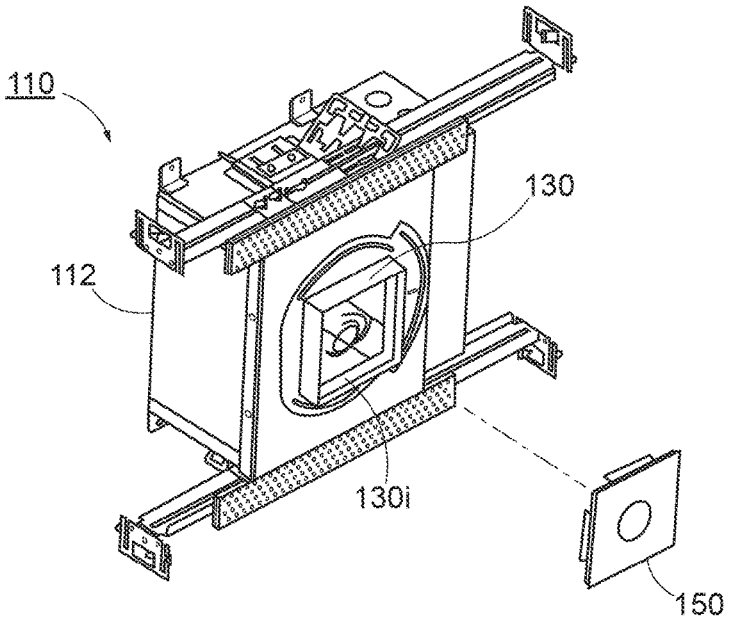
FIGS. 4A and 4B are perspective views illustrating another embodiment of a light fixture device with a removably attached transparent or translucent debris shield according to another embodiment the present disclosure.
Figure 4B:
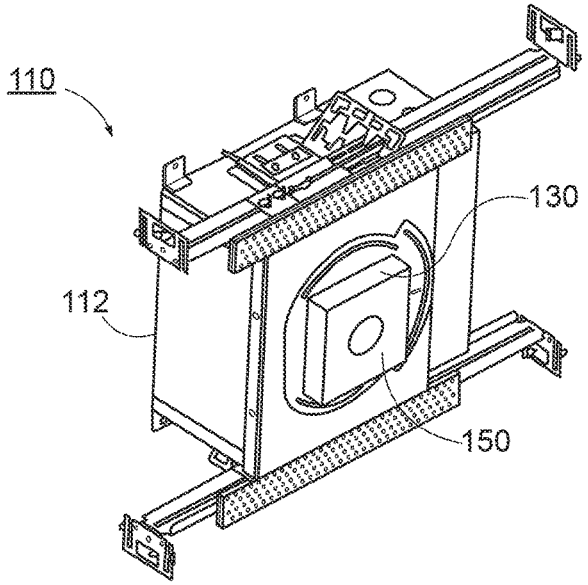

One of ordinary skill in the art will recognize that the debris shield can be configured and adapted to the shape and size of the corresponding trim ring. For example, but not limitation, FIGS. 4A and 4B illustrate an embodiment of a light fixture device 110 with a square trim ring 130 and a debris shield 150 configured and adapted to work therewith. As collectively illustrated in more detailed in FIGS. 5A-5F, the debris shield 150 comprises a flat or substantially flat square-shaped body 152 having an exterior facing surface 154, an interior facing surface 156, and four outer edge surfaces 158 separating the exterior facing surface 154 and the interior facing surface 156. A square skirt 157 depends from the interior facing surface 156 of the body 152. The skirt 157 has a width Ws and a length Ls that is slightly less than the length and width of the opening of the trim ring 130 so that it can enter the trim ring 130. The body 152 has a width WB and a length LB that is slightly greater than the width Ws and the length Ls of the skirt 157 so that the body 152 overhangs the skirt 157. The overhanging portion of the body 152 forms a stop surface 153 which prevents the body 152 from entering the trim ring 130. The stop surface 153 also operates to seal the opening of the trim ring 130 in a manner that prevents construction debris from entering the enclosure 112 of the light fixture device 110 through the trim ring 130 and the light source aperture 128. One or more retaining projections 160 (four illustrated) extend from a free edge surface 159 of the skirt 157. In the embodiment illustrated in FIGS. 5A-5F, one retaining projection 160 extends from the free edge surface 159 of each wall 161 of the skirt 157. As best illustrated in FIG. 5D, each retaining projection 160 defines an L-shaped structure formed by a retaining member 162 and a lead-in member 164. The retaining member 162 extends down and outward from the free edge surface 159 of the wall 161 of the skirt 157 and the lead-in member 164 extends down and inward from the end of the retaining member 162. The junction where the retaining member 162 and the lead-in member 164 merge defines a trim-ring engaging surface 165. The engaging surface 165 extends past the outer edge surface 158 of the body 152 by distance S, which in one illustrative embodiment can be 0.017 inches. The retaining projections 160, in other embodiments, can have any other suitable shape and/structure. For example, in other embodiments, the retaining projections can include just the retaining member extending down and outward from the free edge surface 159 of the skirt 157. As described in the earlier embodiments, the retaining projections 160 can be configured to elastically deform slightly so as to frictionally engage the inner side surfaces 130*i* of the square trim ring 130 when the transparent debris shield 150 is inserted into the opening of the trim ring 130, thereby removably attaching the debris shield 150 to the trim ring 130.

In some embodiments, each inner side surface 130*i* of the square trim ring 130 may include a groove (not illustrated) for receiving a corresponding retaining projection 160 of the debris shield 150 to allow removable attachment of the debris shield 150 to the trim ring 130.

Figure 5A:
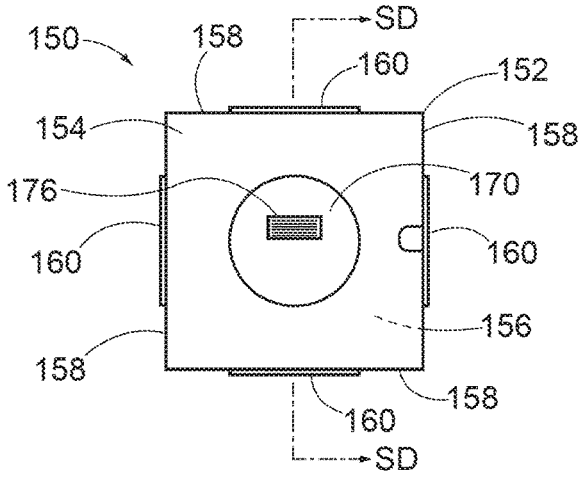
FIG. 5A is a top view of the debris shield illustrated in FIGS. 4A and 4B.
Figure 5B:
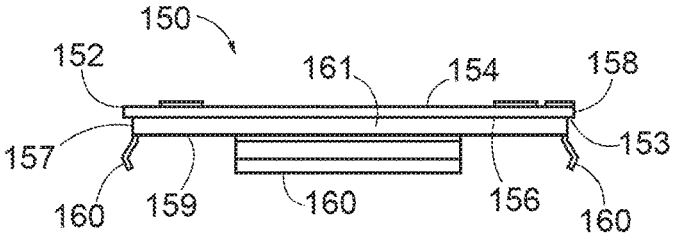
FIG. 5B is a side elevational view of the debris shield illustrated in FIGS. 4A and 4B.
Figure 5C:
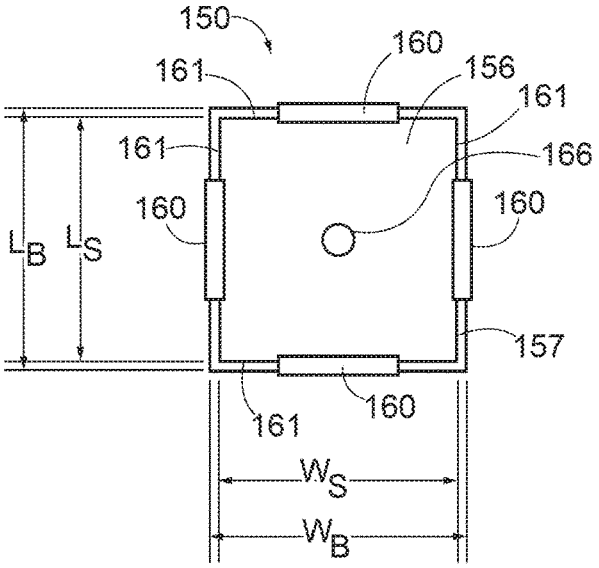
FIG. 5C is a bottom view of the debris shield illustrated in FIGS. 4A and 4B.
Figure 5D:
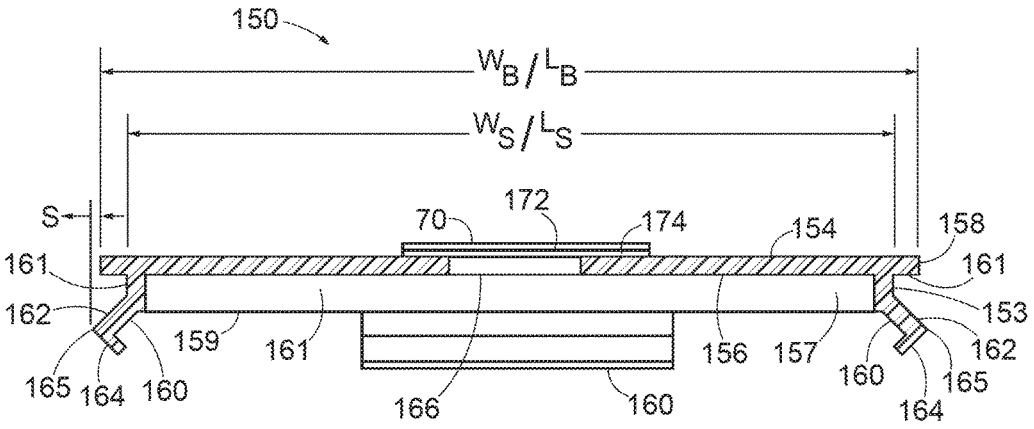
FIG. 5D is a cross-sectional view through line 5D-5D of the debris shield illustrated in FIG. 5A.
Figure 5E:
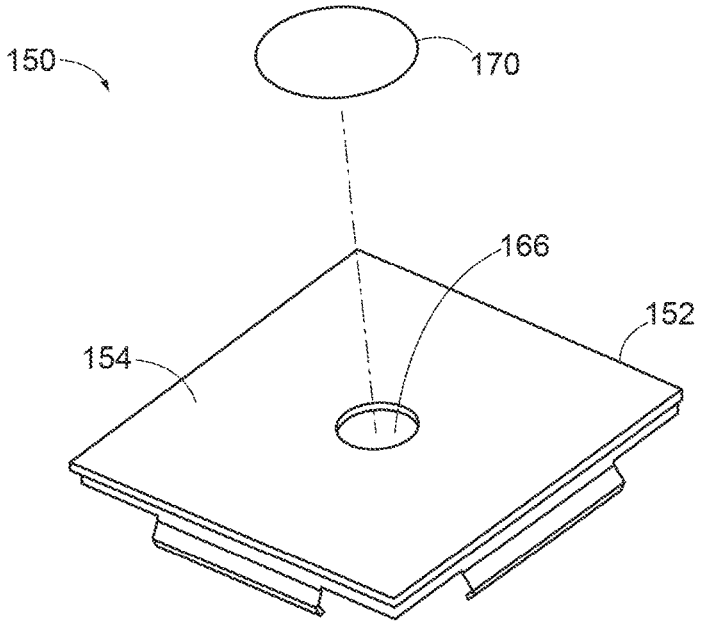
FIG. 5E is an exploded perspective view of the debris shield illustrated in FIGS. 4A and 4B.

Referring to FIGS. 5B, 5D and 5E, the body 152 includes an opening 166 extending therethrough for inserting a finger or tool to remove the debris shield 150 from the trim ring 30 when the construction process has been completed. The opening 166 can be centrally located in the body 152, as shown in FIGS. 5B, 5D, and 5E or located elsewhere in the body 152. A puncturable closure 170 is adhesively attached to the exterior facing surface 154 of the body 152 and entirely covers the opening 166. As previously described, the closure 170 can comprise a substrate 172 of paper or other material, which can be easily punctured by the user's finger or a tool, such as a screw-driver. The rear side of the closure 170 includes an adhesive 174 for attaching the closure 170 to the exterior facing surface 154 of the body 152. The front side of the closure 170 can include a message 176 that instructs the user to allow the debris shield 150 to remain in place until trim of the light fixture device 110 is installed.

Figure 5F:
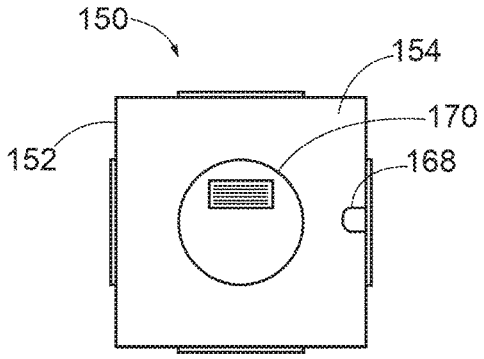
FIG. 5F is a top view of another embodiment of the debris shield that can be used with the light fixture device illustrated in FIGS. 4A and 4B.

Referring to FIG. 5F, an alternative embodiment of the debris shield 150 can be provided with a pull tab 168 disposed on the exterior facing surface 154 of the body 152 to facilitate installation and removal of the debris shield 150, instead of or in addition to the opening 162.

The debris shield 150 can be installed and removed in the same manner as described above with respect to the debris shield 50. More specifically, during installation, the lead-in members 164 of the retaining projections 160 operate to align and center the debris shield 150 with the opening of the trim ring 130. As the debris shield 150 is pressed toward the trim ring 130, the retaining members 162 of the projections 160 elastically deform radially inward as the trim ring engaging surfaces 165 of the projections 160 slide along the inner surface 130*i* of the trim ring 130. The retaining members 162 snap back (radially outward) into their un-deformed state or substantially un-deformed state when the trim ring engaging surfaces 165 enter the groove or grooves (if provided) formed in or on the inner surface 130*i* of the trim ring 130. If no groove or grooves are provided in or on the inner surface 130*i* of the trim ring 130, the forces applied against the inner surface 130*i* of the trim ring 130 by the trim ring engaging surfaces 165, via the elastically deformed retaining members 162, are sufficient to hold the debris shield 150 in the trim ring 130.

The debris shield 150 can be removed by puncturing the closure 170 covering the opening 166 with a finger or tool. The finger or tool can then be inserted into the opening 166 to pull the debris shield 150 out of the trim ring 130. If equipped with the pull tab 168, the pull tab 168 can be grasped with fingers or a tool to pull the debris shield 150 out of the trim ring 130.

The debris shield 50, 150 can be molded of a transparent or translucent plastic material, such as polyethylene, polypropylene, thermoplastic polyesters, polyamides, styrene resins and ABS resins, which permits light generated by the light generating element of the light fixture device to pass through the body 52, 152 of the shield 50, 150. The thickness of the body 52, 152 in one illustrative embodiment can be 0.074 inches.

Figure 6A:
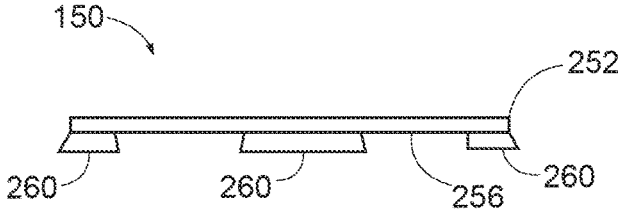
FIG. 6A is a side elevational view of another embodiment of the debris shield the can be used with the light fixture device illustrated in FIGS. 1A and 1B.
Figure 6B:
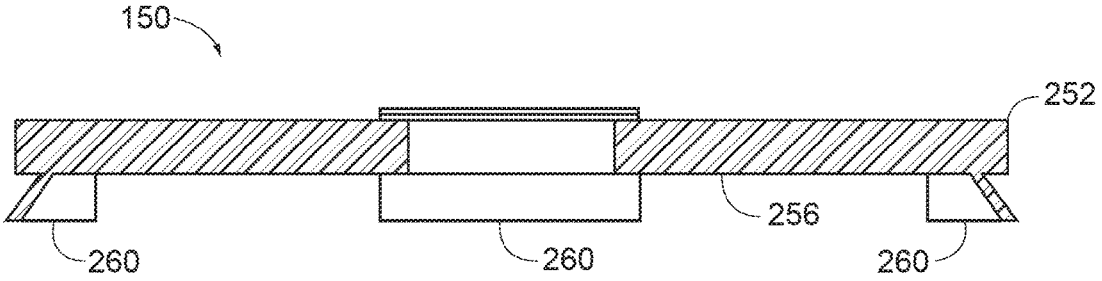
FIG. 6B is a cross-sectional view of debris shield illustrated in FIG. 6A.

FIGS. 6A and 6B illustrate another embodiment of the debris shield 250 that can be used with the light fixture device 10 illustrated in FIGS. 1A and 1B. The debris shield 250 is similar to the debris shields described previously, except that it does not include a skirt. Therefore, the one or more retaining projections 260 is/are arranged on the interior facing surface 256 of the body 252 adjacent to or at the outer edge surface 258 thereof.

Figure 7:
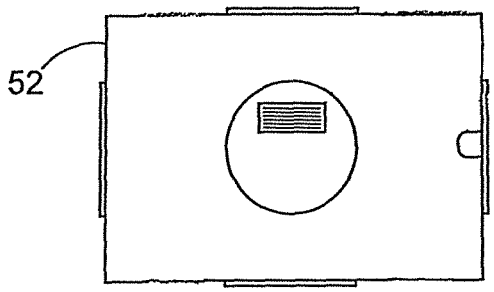
FIG. 7 is a top view of an embodiment of the debris shield that has a rectangular-shaped body.
Figure 8A:
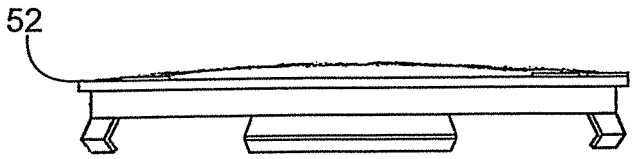
FIG. 8A is a side elevational view of the debris shield that has a convex-shaped body.
Figure 8B:
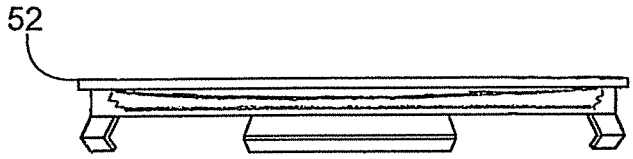
FIG. 8B is a side elevational view of the debris shield with a portion of a skirt broken away to show a concave-shaped body.
Figure 8C:
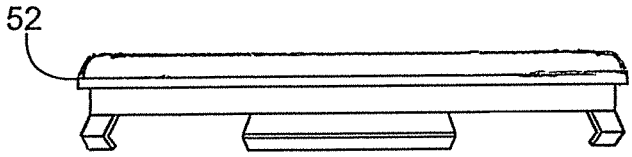
FIG. 8C is a side elevational view of the debris shield that has a dome-shaped body.
Figure 8D:
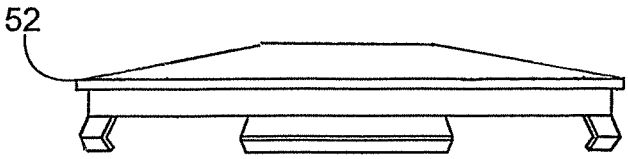
FIG. 8D is a side elevational view of the debris shield that has a frustoconical-shaped body.

Although the debris shield has been described in terms of illustrative embodiments, it is not limited thereto. For example, in some embodiments, the debris shield can have, without limitation, a rectangular-shaped body 52 (FIG. 7), a convex-shaped body 52 (FIG. 8A), a concave-shaped body 52 (FIG. 8B), a dome-shaped body 52 (FIG. 8C), ora frustoconical-shaped body FIG. 8D. Accordingly, the appended claims should be construed broadly to include other variants and embodiments of debris shield, which may be made by those skilled in the art without departing from the scope and range of equivalents thereof.

What is claimed is:

1. A debris shield for a light fixture device, the debris shield comprising:

a transparent or translucent body including an outer edge surface; and at least one projection arranged on or associated with the body for removably retaining the debris shield to the light fixture device, the at least one projection extending outward beyond the outer edge surface of the transparent or translucent body;

whereby the debris shield prevents entry of construction debris into the light fixture device while allowing the light fixture device to be used to illuminate the building area during the construction process.

2. The debris shield of claim 1, wherein the body is disc-, square-, or rectangular-shaped.

3. The debris shield of claim 1, wherein the body is flat, substantially flat, concave, convex, domed, or frustoconical.

4. The debris shield of claim 1, wherein the at least one retaining projection includes four retaining projections.

5. The debris shield of claim 4, wherein the retaining projections are equi-spaced arranged on the body.

6. The debris shield of claim 1, wherein the at least one retaining projection is elastically deformable.

7. The debris shield of claim 1, wherein the at least one retaining projection is substantially rigid.

8. The debris shield of claim 1, wherein the body further includes an opening or a pull tab for removing the debris shield.

9. The debris shield of claim 1, wherein the body further includes an opening for removing the debris shield and a puncturable closure covering the opening.

10. The debris shield of claim 9, wherein the puncturable closure includes instructions relating to the use of the debris shield.

11. The debris shield of claim 1, wherein the body further includes an exterior facing surface and an interior facing surface, the outer edge surface separating the exterior and interior facing surfaces, and wherein the at least one projection is arranged on one of the exterior facing surface, the interior facing surface and the outer edge surface.

12. The debris shield of claim 1, further comprising a skirt depending from a surface of the body, the at least one projection extending from the skirt.

13. The debris shield of claim 12, wherein the at least one projection includes a retaining member and a lead-in member.

14. The debris shield of claim 1, wherein the at least one projection includes a retaining member and a lead-in member.

15. A light fixture device comprising:

an enclosure including a light source aperture surrounded by a trim ring, the light source aperture communicating with an interior of the enclosure;

a light generating element disposed within the interior of the enclosure and aligned with the light source aperture; and the debris shield of claim 1 removably attached to the trim ring;

whereby the debris shield prevents entry of debris into the enclosure while allowing the light generating element to illuminate an adjacent area.

16. The light fixture device of claim 15, wherein an inner surface of the trim ring includes at least one groove for receiving the at least one retaining projection.

17. The light fixture device of claim 15, wherein an inner surface of the trim ring includes at least one L-shaped groove for receiving the at least one retaining projection.

18. A method for preventing debris from entering a light fixture device during a construction process while allowing the light fixture device to be used to illuminate an area where the construction process is taking place, the light fixture device having a light source aperture communicating with an interior of the light fixture device, a light generating element disposed within the interior of the light fixture device and aligned with the light source aperture, and a trim ring surrounding the light source aperture, the method comprising:

providing a debris shield comprising a transparent or translucent body including an outer edge surface and at least one projection arranged on or associated with the body, the at least one projection extending outward beyond the outer edge surface of the transparent or translucent body;

removably attaching the debris shield to the trim ring of the light fixture device, the at least one projection removably retaining the debris shield to the trim ring;

activating the light generating element to illuminate the area; and removing the debris shield from the trim ring after the construction process is completed.

19. The method of claim 18, wherein the removing of the debris shield from the trim ring after the construction process is completed includes puncturing a closure covering an opening in the body of the debris shield and grasping the opening to pull the debris shield from the trim ring.

20. The method of claim 18, wherein the removing of the debris shield from the trim ring after the construction process is completed includes grasping a pull tab on the body of the debris shield and using the pull tab to pull the debris shield from the trim ring.

* * * * *